United States Patent [19]

Yunick

[11] 4,068,635

[45] Jan. 17, 1978

[54] PRESSURE VENT

[76] Inventor: Henry Yunick, 1175 N. Halifax, Daytona Beach, Fla.

[21] Appl. No.: 693,920

[22] Filed: June 8, 1976

[51] Int. Cl.[2] ..... F01M 13/00; F02M 7/00

[52] U.S. Cl. ..... 123/119 B; 123/41.86; 137/38

[58] Field of Search ..... 123/41.86, 119 B, 90.37, 123/90.38, 195 C; 137/38, 39, 111

[56] References Cited

U.S. PATENT DOCUMENTS

| | | | |
|---|---|---|---|
| 2,056,762 | 10/1936 | Barr | 123/119 B |
| 2,386,765 | 10/1945 | Adams | 123/119 B |
| 2,461,206 | 2/1949 | Fouse | 123/119 B |
| 3,550,567 | 12/1970 | Crow | 123/41.86 |
| 3,698,160 | 10/1972 | Hunter | 137/38 |
| 3,765,386 | 10/1973 | Ottofy | 123/41.86 |
| 3,875,916 | 4/1975 | Patton | 123/41.86 |
| 3,910,301 | 10/1975 | Kuss | 137/38 |
| 3,949,719 | 4/1976 | Bellanca | 123/41.86 |
| 3,972,340 | 8/1976 | Miller | 137/38 |
| 3,983,890 | 10/1976 | Rogers | 137/38 |

*Primary Examiner*—Charles J. Myhre
*Assistant Examiner*—Daniel J. O'Connor
*Attorney, Agent, or Firm*—John N. Randolph

[57] ABSTRACT

A valve is interposed between spaced valve seats of a conduit having end portions communicating with the ends of an internal combustion engine valve cover. The conduit has a vent port located between the valve seats. The valve, which is responsible to inertia and centrifugal forces, is disposed in the conduit between the valve seats for shutting off one or the other ends of said conduit to prevent the loss of upper engine lubricants from the valve cover during rapid acceleration, deceleration or sharp cornering of a vehicle driven by the engine.

8 Claims, 2 Drawing Figures

FIG. 1
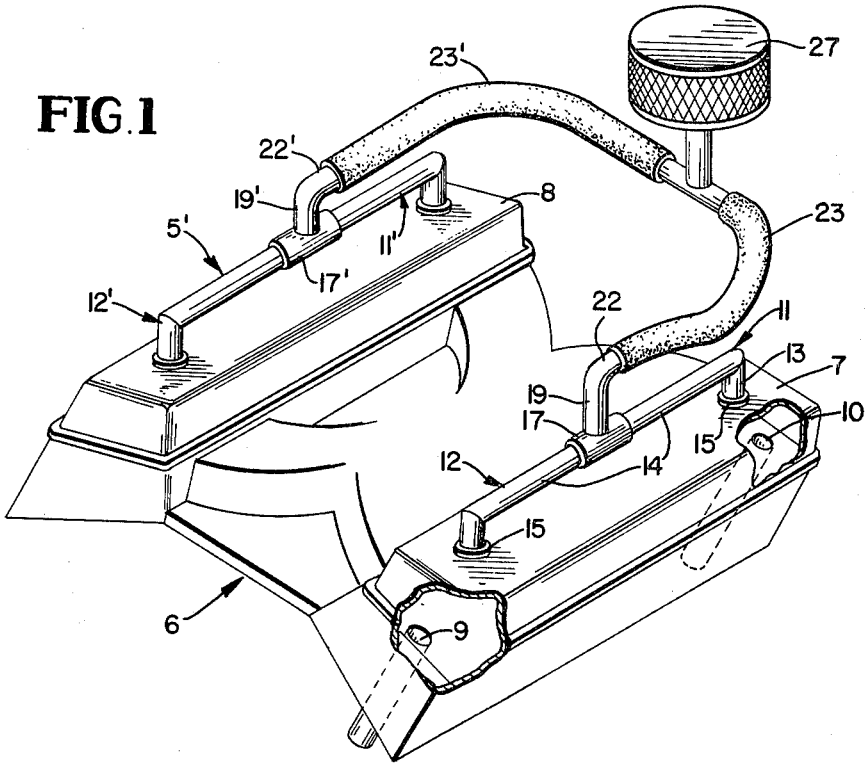
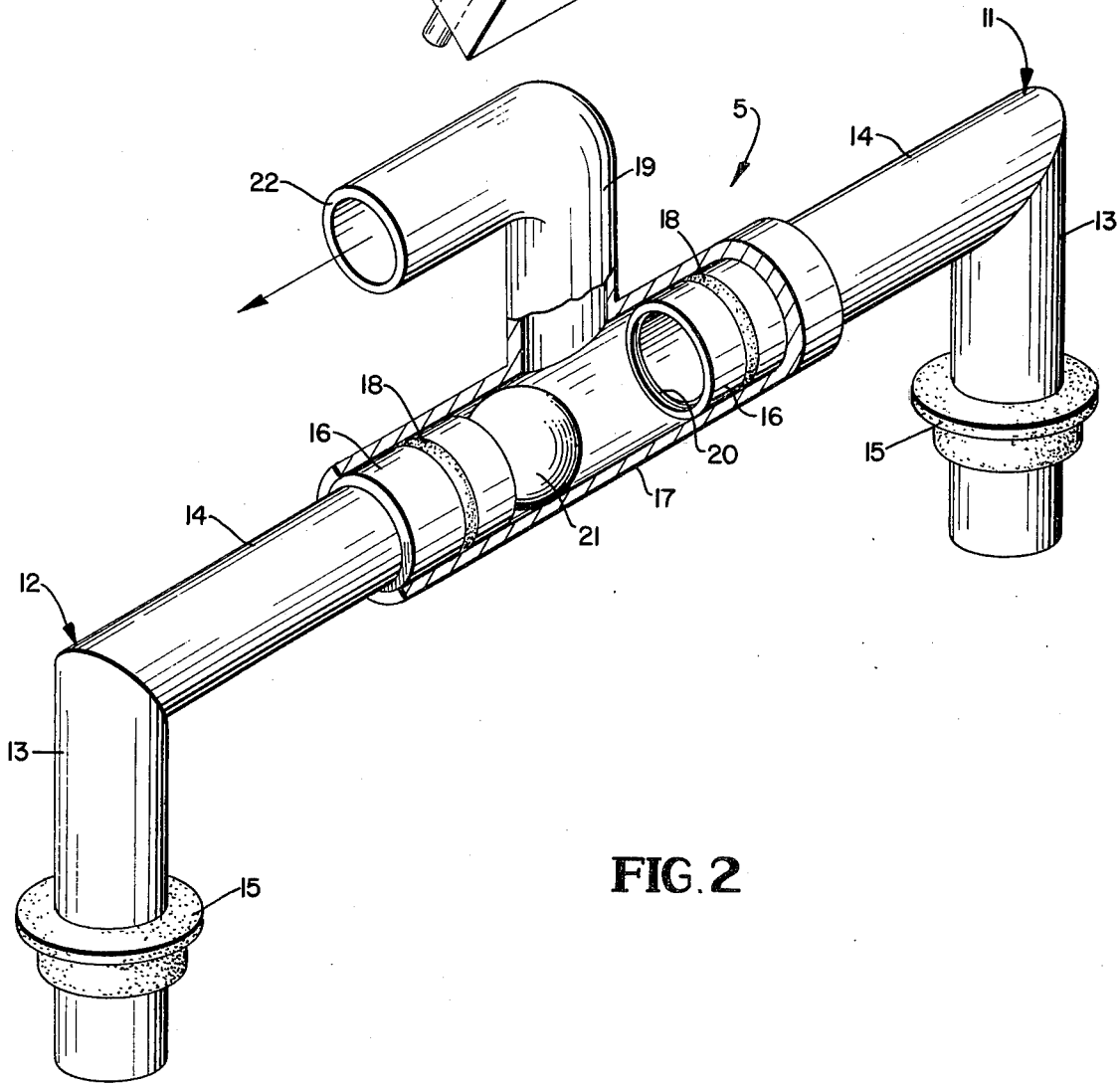
FIG. 2

PRESSURE VENT

SUMMARY

It is a primary object of the present invention to provide a means for venting an engine, while in motion, without the loss of lubricating fluid.

More particularly, it is an object of the invention to provide a venting arrangement for an internal combustion engine including a conduit for venting a valve cover from either end thereof, having valve means for shutting off the conduit at an end of the cover which is flooded with lubricant, due to rapid acceleration or deceleration of the vehicle equipped with the engine, or as a result of centrifugal forces occuring during sharp cornering of the vehicle.

Various other objects and advantages of the invention will hereinafter become more fully apparent from the following description of the drawing, illustrating one presently preferred embodiment thereof, and wherein:

BRIEF DESCRIPTION OF THE DRAWING

FIG. 1 is a perspective view, partly broken away, of the top portion of a V-type engine equipped with a venting system, utilizing the invention, and FIG. 2 is an enlarged perspective view, partly in section, of the pressure vent.

DESCRIPTION OF THE PREFERRED EMBODIMENT

Referring more specifically to the drawing, for the purpose of illustrating one application of the venting unit, designated generally 5 and illustrated in its entirety in FIG. 2, a portion of the top part of a V-type internal combustion engine has been illustrated in FIG. 1, and is designated generally 6. The illustrated portion of the engine 6 includes two valve covers 7 and 8 and two oil drain passages 9 and 10 which lead back to the engine crankcase, not shown, from the top surface portion of the engine enclosed by the cover 7, which has been broken away to show the drain passages 9 and 10. Obviously, two corresponding drain passages, not shown, are disposed beneath the cover 8.

The vent unit 5 comprises two angular conduits 11 and 12 each having a nearly vertical leg 13 and a substantially horizontal leg 14. The vertical legs 13 extend downwardly through openings, not shown, located adjacent the ends of the cover 7 and which are line by rubber grommets 15 having top flanges bearing on the top surface of said cover 7.

The horizontal legs 14 extend toward and terminate in spaced apart relation to one another. A collar 16 is secured on the terminal of each leg 14. A sleeve 17 has end portions engaging over the collars 16 to provide a coupling between the conduit ends 14. Said collars 16 are grooved to accommodate O-ring seals 18 for sealing the joints between the sleeve 17 and conduit portions 14. An outlet tube 19, which is preferably formed integral with the sleeve 17, extends laterally therefrom approximately midway between and spaced from the adjacent ends of the collars 16. Said adjacent ends of the collars 16 are internally bevelled to provide valve seats 20. A ball valve 21, preferably in the form of a heavy metal ball, is disposed for movement in the sleeve 17 between the valve seats 20. Whne the ball 21 is engaging one of the valve seats 20, for example, the valve seat of the conduit 12, as illustrated in FIG. 2, the tube 19 is in communication with the other conduit 11.

FIG. 1 shows the venting device 5 reversed relative to its position of FIG. 2, with the leg 13 of the conduit 11 engaging through a forward portion of the cover 7 and with the leg 13 of the other conduit 12 engaging through a rear portion of said cover. A second venting unit 5', which is identical with the venting unit 5, is shown applied in the same manner to the other cover 8. The outlet tube 19 and an outlet tube 19', of the unit 5', are shown as having discharge ends 22 and 22', respectively, disposed substantially parallel to the sleeves 17 and 17', and which extend rearwardly with respect to the covers 7 and 8. Conduits 23 and 23' have complimentary ends engaging over said discharge ends 22 and 22', respectively, and opposite ends engaging over and connected to the ends of a tube 24 of an inverted T-coupling 25 having an upstanding cross leg 26 which discharges into and supports a conventional breather unit 27.

From the foregoing, it will be readily apparent that when a vehicle propelled by the engine 6 is accelerating rapidly, the oil in the valve covers 7 and 8 will be caused by inertia forces to accumulate in and fill the rear ends of the valve covers. As this oil cannot be carried off by the return tubes 10, it will fill the conduits 11 and 11' and would escape through the outlet tubes 19 and 19' except for the ball valve 21 and a corresponding ball valve, not shown, of the unit 5'. The inertia forces which cause the oil to collect in the rear ends of the covers 7 and 8 will also cause the valves to seat against the valve seats of the conduits 11 and 11' to prevent escape of this oil to the atmosphere through the breather 27. However, the engine will be vented through the conduits 12 and 12' which communicate with forward portions of the covers 7 and 8.

In the same manner, when decelerating rapidly, the oil will crowd into the forward ends of the covers 7 and 8 but will be prevented from being blown out through the vent tubes 19 and 19' by the ball valves seating against the forward valve seats of the conduits 12 and 12'. The engine will then be vented through the rear conduits 11 and 11' and the vent tubes 19 and 19'. The same result occurs when cornering at a high speed as when accelerating rapidly. Centrifugal force causes the oil in the covers 7 and 8 to crowd into the back ends of said covers, but the oil is prevented from escaping by the ball valves seating against the rear valve seats of the conduits 11 and 11'.

The invention has been described in connection with a V-type engine. However, it is equally well adapted to other types of engines, such as where the cylinders are all in line. In such engines, having only a single valve cover, only the one unit 5 would be utilized.

While the invention as described would be utilized with race cars or high performance vehicles where at high r.p.m. oil flow to the top of the engine increases dramatically, the invention is also adapted for use with other vehicles and the discharge end 22 of the outlet tube, which could be of any desired shape and which could extend in any direction, could be connected to the carburetor air cleaner or to any device, not shown, for venting and oil separation.

Various other modifications and changes are contemplated and may be resorted to, without departing from the function or scope of the invention.

I claim as my invention:

1. A pressure vent for an internal combustion engine comprising a conduit having ends connected to and communicating with end portions of a valve cover of an internal combustion engine, said conduit having spaced apart internally disposed valve seats, an outlet port between the valve seats, and a valve disposed in said conduit for movement between said valve seats and responsive to inertia and centrifugal forces for closing one or the other of said conduit ends during rapid acceleration, deceleration, or sharp cornering of a vehicle propelled by the engine.

2. A pressure vent as in claim 1, said conduit comprising angular tubes having complimentary ends connected to the valve cover and aligned opposite ends extending toward one another, and a sleeve engaging over terminals of said aligned ends.

3. A pressure vent as in claim 2, said terminals of the aligned ends providing said valve seats, and said ball valve being movable in said sleeve between the valve seats.

4. A pressure vent as in claim 1, said conduit including an enlarged intermediate portion disposed between said valve seats, which is provided with said outlet port and which accommodates said ball valve.

5. A pressure vent as in claim 4, said enlarged intermediate portion constituting a part of a sleeve, said conduit including end portions having adjacently disposed terminals secured in end portions of the sleeve.

6. A pressure vent as in claim 5, and collars engaging said terminals of the end portions and secured in the sleeve ends, said collars having bevelled adjacent ends defining said valve seats.

7. A pressure vent as in claim 5, said outlet port comprising a tube projecting transversely from said sleeve.

8. A pressure vent as in claim 7, said last mentioned tube having angularly disposed end portions.

* * * * *